US005111108A

United States Patent [19]

Goodman et al.

[11] Patent Number: 5,111,108

[45] Date of Patent: May 5, 1992

[54] VAPOR DISCHARGE DEVICE WITH ELECTRON EMISSIVE MATERIAL

[75] Inventors: David A. Goodman, Amesbury; John L. Plumb, Danvers, both of Mass.; Rudy E. M. Geens, Leuven, Belgium; Richard A. Snellgrove, Danvers; Elliot Wyner, Peabody, both of Mass.

[73] Assignees: GTE Products Corporation, Danvers, Mass.; GTE Sylvania N.V., Belgium

[21] Appl. No.: 627,529

[22] Filed: Dec. 14, 1990

[51] Int. Cl.[5] ..... H01J 51/073

[52] U.S. Cl. ..... 313/630; 313/628; 252/521

[58] Field of Search ..... 313/630, 628; 252/521

[56] References Cited

U.S. PATENT DOCUMENTS 3,708,710 1/1973 Smyser et al. ..... 313/630 X
3,919,581 11/1975 Datta .
4,044,276 8/1977 Keeffee et al. .
4,052,634 10/1977 Dekok ..... 313/630
4,152,619 5/1979 Bhalla ..... 313/218
4,210,840 7/1980 Bhalla ..... 313/218
4,620,128 10/1986 Luthra ..... 313/630
4,806,829 2/1989 Nakao .

FOREIGN PATENT DOCUMENTS

0159741A1 10/1985 European Pat. Off. .

*Primary Examiner*—Palmer C. DeMeo
*Attorney, Agent, or Firm*—Young & Thompson

[57] ABSTRACT

An emissive material for use in a vapor discharge device including reacted $Ba_xSr_{1-x}Y_2O_4$ wherein X satisfies the following: $1>X\geqq 0$. A vapor discharge device is provided having an arc tube which includes electrodes therein coated with such emissive material.

14 Claims, 9 Drawing Sheets

VAPOR DISCHARGE DEVICE WITH ELECTRON EMISSIVE MATERIAL

BACKGROUND OF THE INVENTION

1. Field of the Invention

The present invention relates to an emissive material for use in a vapor discharge device, and to a vapor discharge device having an arc tube which includes electrodes therein coated with such emissive material 2. Description of the Prior Art The present invention will be described herein in the context of a high pressure sodium vapor discharge lamp. However, the scope of the present invention is not limited to such lamps but also covers other vapor discharge devices such as, without limitation, HCRI sodium, unsaturated vapor sodium, fluorescent, high pressure mercury, and other alkali metal lamps. Such lamps are known in the art. For example, high pressure sodium lamps containing low or unsaturated fills of sodium and mercury are known to the art, as are lamps which use electrodes that include thorium oxide, yttrium oxide, oxide compounds containing the oxides of barium, calcium, tungsten, and yttrium, and oxide compounds containing strontium and yttrium oxides. Such lamps have frequently suffered from a loss of sodium as a constituent of the arc stream which is confined within the arc tube during operation of the lamp. The loss of this sodium reduces the luminance of the lamp.

Examples of current art emission mixtures for high pressure sodium lamps include dibarium calcium tungstate as described in U.S. Pat. No. 3,708,710, yttrium oxide as described in Japanese Patent No. 62-82640, thorium oxide as described in U.S. Pat. No. 3,919,581, strontium yttrium oxide as described in European patent application EP 0159 741, tribarium diyttrium tungstate as described in U.S. Pat. No. 4,152,619, and a reacted mixture of barium zirconate and strontium zirconate as described in U.S. Pat. No. 4,210,840. An example of current art emission mixes for high pressure mercury lamps contains barium-calcium-hafnium carbonate-oxide mixtures as described in U.S. Pat. No. 4,044,276. All of the foregoing materials exhibit several problems. For example, yttria emission materials have a high work function and operate at high electrode temperatures. Dibarium calcium tungstate and tribarium diyttrium tungstate are reactive with sodium in unsaturated vapor lamps. Thorium oxide is radioactive which poses health problems. The barium-calcium-hafnium oxide mixtures are somewhat reactive with the ambient atmosphere and release water and carbon containing gases into the lamp during manufacture which react with tungsten electrode structures. The strontium yttrium oxide compound shows electrode voltage rise and lumen loss with life.

A more recent effort to reduce the rate of sodium loss from an arc tube in a high pressure sodium vapor discharge device is set forth in U.S. Pat. No. 4,806,829 which is assigned to the same assignee as the present application. This patent teaches the use of an emission material which includes an oxygen getter, such as, zirconium and/or niobium, and thorium dioxide.

It is an object of the present invention to overcome the disadvantages of such conventional emissive material and to provide an emissive material which is highly refractory and has an excellent electron emitting activity, very low sodium reactivity, low operating temperature, good starting characteristics, low initial deterioration of the D line such that the sodium D line remains high for the life of the lamp, low electrode voltage, good lumen maintenance, and ease of manufacture.

SUMMARY OF THE INVENTION

This invention achieves these and other results by providing an improved emissive material and a vapor discharge device comprising such emissive material. The vapor discharge device comprises an arc tube having a discharge sustaining fill and a pair of electrodes sealed through opposite ends of the arc tube and adapted to have an elongated arc discharge maintained therebetween. Means is provided to connect current to each electrode of the pair of electrodes. The emissive material is disposed on each electrode, such emissive material comprising a reacted mixture of barium-strontium-yttrium oxides particularly in the form of the ceramic alloys $Ba_xSr_{1-x}Y_2O_4$ wherein X satisfies the following:

$$1>X\geqq 0$$

In one embodiment of the invention, X is in the range of from 0.05 to 0.95. Examples of such emissive material include, without limitation, $Ba_{0.5}Sr_{0.5}Y_2O_4$; $Ba_{0.25}Sr_{0.75}Y_2O_4$; $Ba_{0.75}Sr_{0.25}Y_2O_4$. The reacted emissive material can be prepared and applied to the electrode as described herein. Alternatively, the electrode can be coated with $xBaCO_3+(1-x)SrCO_3+Y_2O_3$ which can be fired to form the reacted emissive material.

DESCRIPTION OF THE PREFERRED EMBODIMENT

Figure 1:
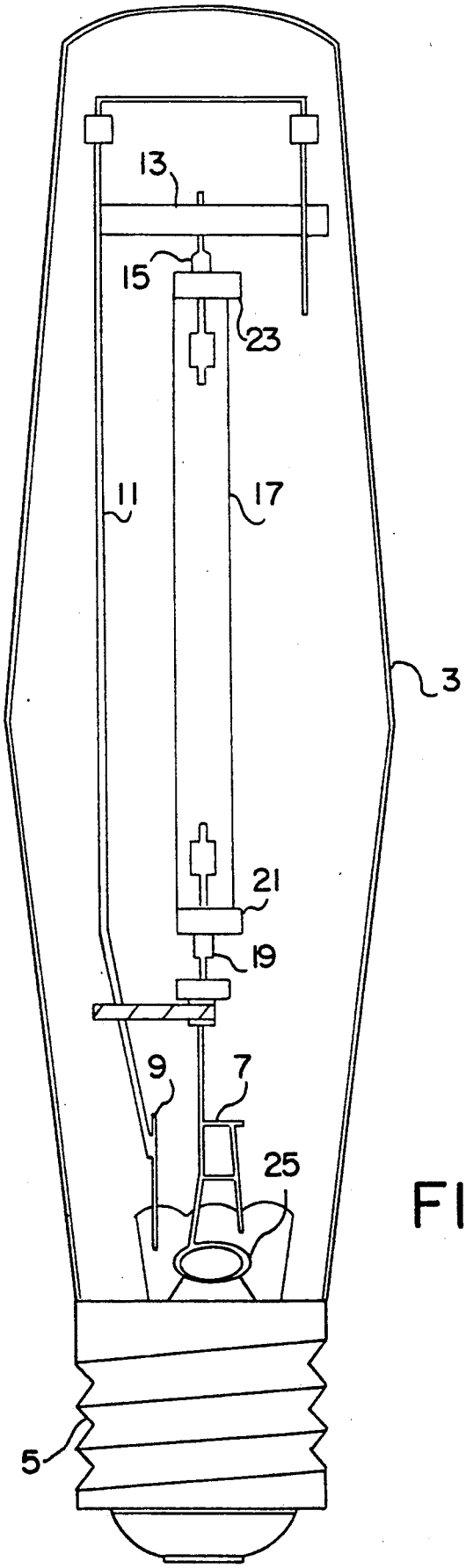
FIG. 1 is an elevational view of a high pressure sodium lamp of the present invention.

The embodiment of this invention which is illustrated in the drawings is particularly suited for achieving the objects of this invention. FIG. 1 depicts a high pressure sodium vapor discharge device including an outer glass envelope 3 which is formed for insertion in a normal screw type metal base 5. A glass stem portion 7 is hermetically sealed to the glass envelope 3 and extends inwardly therein. The stem portion 7 has a plurality of electrical lead-in conductors 9 sealed therein and extending therethrough. An electrically conductive support member 11 is affixed to one of the electrical conductors 9 and to a metal crossmember 13 which is attached to a niobium tube 15 at one end of an elongated polycrystalline alumina arc tube 17. Another niobium tube 19 is located at the opposite end of the arc tube 17 and attached to one of the electrical conductors 9 passing through the stem portion 7. Each niobium tube 15 and 19 can be replaced with a niobium wire or rod, if desired. Preferably, heat insulating sleeves 21 and 23 are slipped over the opposite ends of the arc tube 17 in the vicinity of the tubes 19 and 15, respectively. Preferably, the envelope 3 is evacuated and at least ne getter device 25, preferably barium, is positioned adjacent the stem portion 7.

Further, a discharge sustaining fill including sodium, mercury, and xenon is disposed within the arc tube 17. The fill of mercury and sodium may be of an amount sufficient to "saturate" or provide an excess amount of sodium therein but preferably only sufficient sodium and mercury is added to provide an unsaturated vapor type lamp. The approximate amounts of sodium and mercury to obtain an unsaturated condition are well known to the art. A suitable amount of xenon is added to facilitate starting and improve lumen maintenance as is known in the art.

Figure 2:
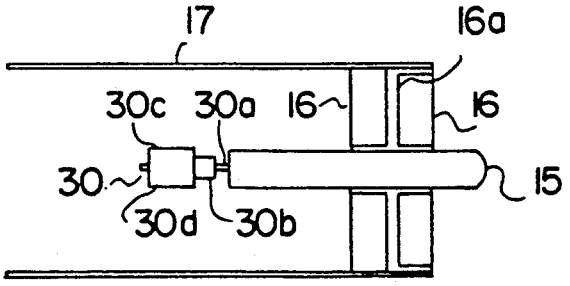
FIG. 2 is a partial side elevational view, partially in cross section, of an arc tube and electrode configuration containing the emission material of the present invention and suitable for use in the present invention.

Referring to FIG. 2, the arc tube includes a conventional polycrystalline alumina tube 17 which is transparent to light that is emitted by an arc formed within the arc tube. In the preferred embodiment, arc tube 17 is sealed at each end with at least one section of substantially flat polycrystalline alumina. Each alumina section has a hole therein and is sealed to the tube with a glass or ceramic frit. A niobium tube is disposed in a respective hole and sealed to a respective alumina section. For example, in the embodiment of FIGS. 1 and 2, a pair of alumina buttons 16 is sealed to the arc tube 17 by a conventional frit 16*a*. Another pair, not shown, is sealed to the other end, also not shown. Alumina buttons 16 are disposed in the arc tube in a back-to-back relationship and joined together with a frit 16*a*. The niobium tube 15 is axially disposed in the alumina buttons 16 and is sealed to the alumina buttons 16 by the frit 16*a*. An end of electrode 30 is disposed within the center of the niobium tube 15 on a tungsten rod 30*a*. The rod 30*a* supports the electrode upon which an arc will be formed in the tube when the lamp is operated. Preferably, the electrode is a coil. In the preferred embodiment, the coil is formed of a screw-wrapped base section 30*b* of tungsten wire with an over-screw section 30*c* which is backwound over the base section. The rod 30*a* is disposed on the axis of the windings. The niobium tube 19 with a similar electrode is disposed in a like manner at the opposite end of arc tube 17. Although the electrode 30 is in the form of a coil-like structure, the electrode can be in the form of wires or cermets and the like. In the preferred embodiment, the coil or electrode 30 is formed from tungsten. However, alternative embodiments are contemplated herein wherein electrode 30 is formed from, without limitation, tungsten, molybdenum, rhenium, tantalum, and mixtures thereof.

An emissive material 30*d* is disposed on each electrode 30 in accordance with the present invention. Such emissive material 30*d* comprises reacted $Ba_xSr_{1-x}Y_2O_4$ wherein X satisfies the following:

$$1>X\geqq 0$$

As noted above, alternatively the electrode 30 can be coated with $xBaCO_3+(1-x)SrCO_3+Y_2O_3$ which can be fired to form the reacted emissive material $Ba_xSr_{1-x}Y_2O_4$.

In the preferred embodiment each electrode 30 is coated with emissive material 30*d*. To prepare the coated electrodes, and without limitation, the emissive material including barium carbonate, strontium carbonate, and yttrium oxide powders are admixed, slurried in methanol or water, and vibration ball milled with zirconia. The oxide compound precursors can be slurried in suitable carriers other than methanol or water, such as ethanol or butyl acetate. The resultant powder mix is dried. Such drying will typically be at about 50° C. if a methanol slurry is used and about 80° C. if a water slurry is used. The dried mix is then fired in air at 1500° C. for twenty-two hours to produce a reacted mixture of barium-strontium-yttrate. This compound is then vibration ball milled in methanol with zirconia media. The resulting emission mix methanol slurry is then used to coat each electrode 30.

In the preferred coating process, each electrode is vacuum impregnated from the emission mix methanol slurry. Preferably, such impregnation is effected in the presence of ultrasonic vibration. The coated electrode is then dried at 50° C. for about one half hour. This is followed by sintering the coated electrodes in a hydrogen containing atmosphere at 1200° C. to 2000° C., and preferably at 1600° C. for about forty-five minutes. Alternatively, the impregnated electrodes can be fired in vacuum or inert gas atmospheres. Upon completion of sintering, the surface of the electrode is cleaned of excess oxide materials by tumbling the electrodes in a jar in a know manner.

Variations of the emissive material are possible. For example, the emissive material can also include refractory metals such as, for example, powdered tungsten, molybdenum, rhenium, titanium, zirconium, other refractory metals, and mixtures thereof from 5 to 50 weight percent. The emissive material can also include oxides such as, for example, hafnium oxide, zirconium oxide, yttrium oxide, rare earth oxides, aluminum oxide, calcium oxide, and mixtures thereof. It is also contemplated herein for the impregnation mix to include one or more binders such as, for example, nitrocellulose.

In addition to the carbonates and oxides discussed herein, the emission materials can also be obtained from precursors such as hydroxides, nitrates, oxalates or other materials which react in oxygen and heat to form oxides. Without limitation, it is believed that the ratio of barium carbonate plus strontium carbonate to yttrium oxide can be varied between about 0.5 to 0.05. In this composition range the phases present in the emitter will be $Ba_xSr_{1-x}Y_2O_4$ and $Y_2O_3$. The extra $Y_2O_3$ does not degrade the performance of the mixed yttrate compound. At ratios above 0.5 alkaline earth oxide rich phases such as BaO, SrO, or $Ba_3Y_4O_9$ will be present in the emission mix. These phases are very reactive with moisture in the air and will require special handling in the manufacturing process.

Specific preferred embodiments are described in the following examples:

EXAMPLE 1

One mole of barium carbonate, one mole of strontium carbonate, and 2.08 moles of yttrium oxide powders were admixed, slurried in methanol, and vibration ball milled with zirconia for two hours. The resultant powder mix was dried at about 50° C. and then fired in air at 1500° C. for twenty-two hours to produce a reacted mixture of barium, strontium, and yttrium oxides. In particular, $Ba_{0.5}Sr_{0.5}Y_2O_4$ (also referred to herein as $BSY_2$) was produced. This compound was then vibration ball milled in methanol with zirconia media. The material resulting from this process was shown by X-ray diffraction analysis and scanning electron microscopy (SEM) analysis to be almost entirely the single phase compound $Ba_{0.5}Sr_{0.5}Y_2O_4$ with a small amount of $Y_2O_3$; that is, about 4% $Y_2O_3$.

EXAMPLE 2

One quarter mole of barium carbonate, three quarter mole of strontium carbonate, and 2.08 moles of yttrium oxide powders were processed as in Example 1. The material resulting from this process was shown by X-ray diffraction and SEM analysis to be the single phase compound $Ba_{0.25}Sr_{0.75}Y_2O_4$ (also referred to herein as $BS_3Y_4$) with a small amount of $Y_2O_3$; that is, about 4% $Y_2O_3$.

EXAMPLE 3

Three quarter mole of barium carbonate, one quarter mole of strontium carbonate, and 2.08 moles of yttrium oxide powders were processed as in Example 1. The material resulting from this process was shown by X-ray diffraction and SEM analysis to be the single phase compound $Ba_{0.75}Sr_{0.25}Y_2O_4$ (also referred to herein as $B_3SY_4$) with a small amount of $Y_2O_3$; that is, about 4% $Y_2O_3$.

In addition to EXAMPLES 1 to 3, a prior art $SrY_2O_4$ emission material was formed as follows:

EXAMPLE 4

One mole of strontium carbonate and 1.04 moles of yttrium oxide powders were processed as in Example 1. The material resulting from this process was shown by X-ray diffraction and SEM analysis to be the single phase compound $SrY_2O_4$ (also referred to herein as SY) with a small amount of $Y_2O_3$; that is, about 4% $Y_2O_3$.

Figure 3A:
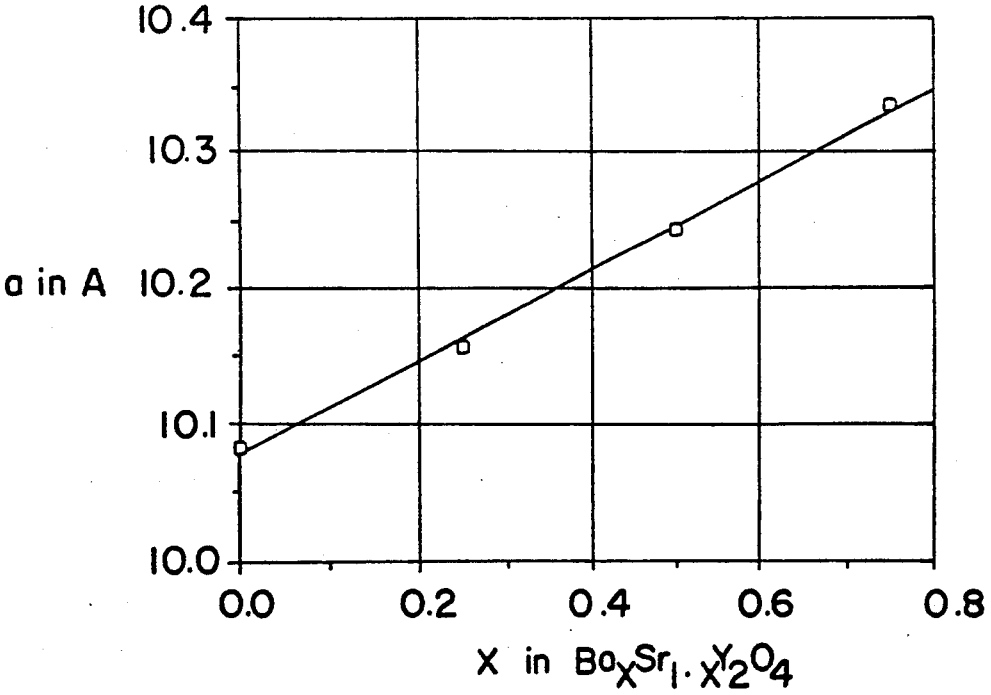
FIGS. 3*a*, 3*b*, 3*c* are graphs of the a, b, c lattice parameters of $Ba_xSr_{1-x}Y_2O_4$ alloys as determined by X-ray diffraction.
Figure 3B:
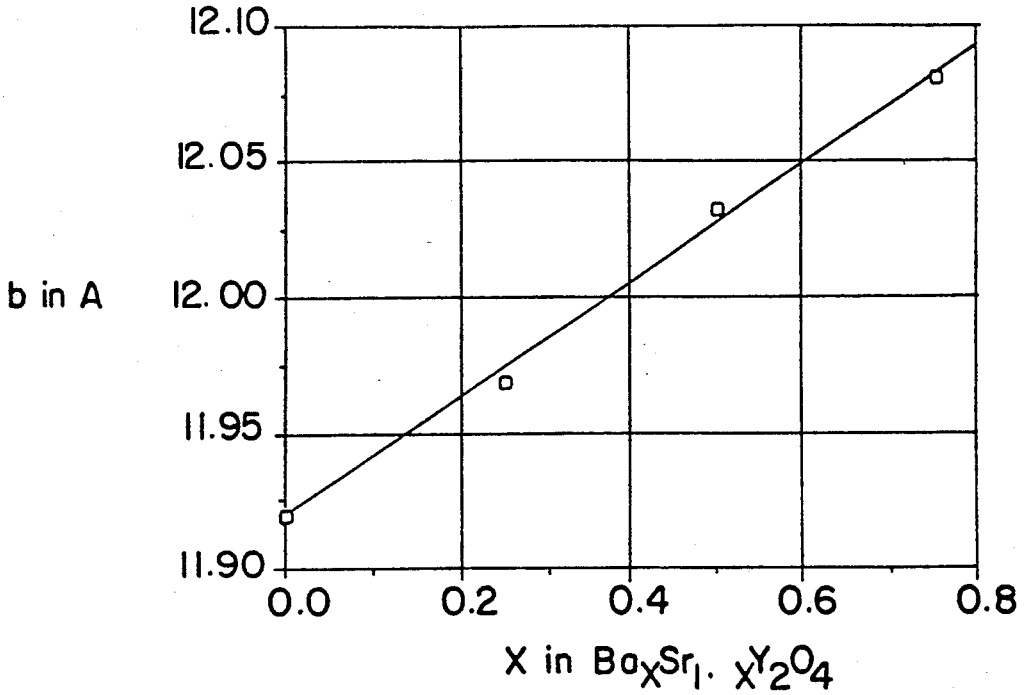
Figure 3C:
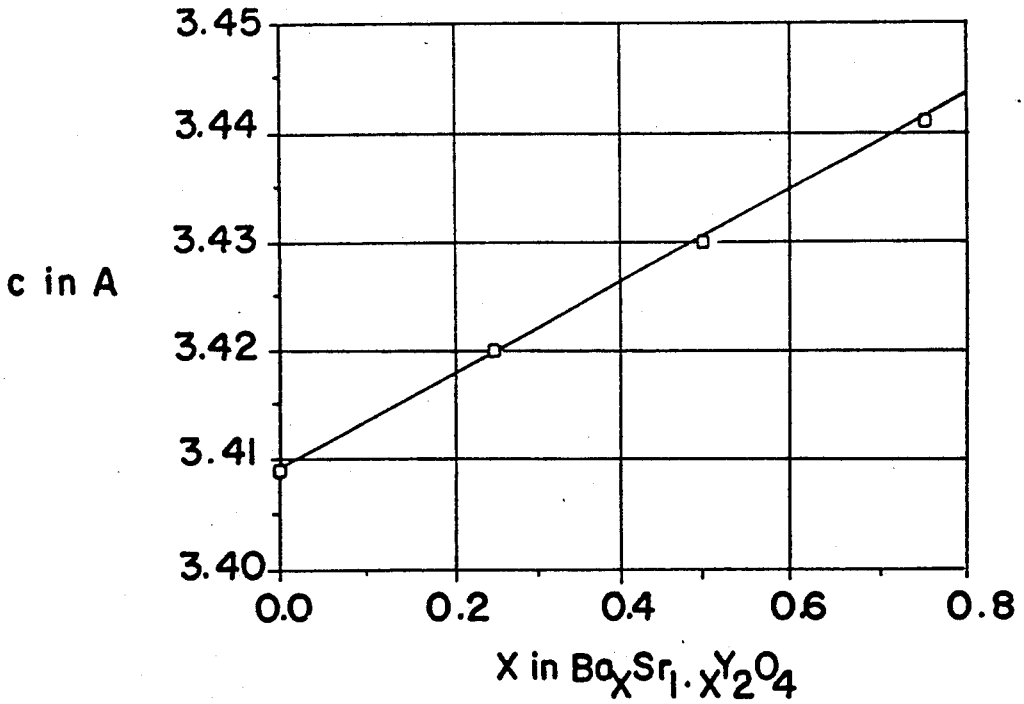

In considering the characteristics of an emission material, in addition to the actual chemical composition of the emitter, the phases and crystal structures of the oxides present on a cathode have an important affect upon lamp performance. For example, some chemical compounds change crystal structures on heating to high temperatures, and this makes them unsuitable for lamps. In evaluating these characteristics crystal structures and phases of the embodiments of Examples 1 to 4 were established. In particular, mixtures of $Ba_xSr_{1-x}Y_2O_4$ with X being equal to 0.0, 0.25, 0.50, and 0.75 were formed using the techniques of EXAMPLES 1 to 4. An X-ray diffraction pattern was taken of such mixtures. Such diffraction pattern shows whether the reacted mixture is a single phase solid solution or a mechanical mixture of multiple phases. Powder X-ray diffraction patterns for the materials in EXAMPLES 1 to 4 can each be indexed to a single orthorhomic lattice, which is indicative that each material is a single phase rather than a mixture of compounds and that the compound is stable from room temperature to the operating temperature of the emitter. In addition, analysis of the three orthorhomic lattice parameters a, b, and c, which measure the size of the basic rectangular unit cell from which the orthorhomic lattice is built, shows that the phases in EXAMPLES 1 to 4 are not discrete separate compounds. Instead they are members of a complete solid solution series in which strontium and barium substitute for each other in all proportions. FIGS. 3*a–c* show that all three lattice parameters vary smoothly and nearly linearly with the fraction of barium, X. There is no discontinuity in the size of the unit cell as X varies from 0 to 0.75 as would occur if more than one crystalline phase were formed. The reacted mixtures in the above examples therefore form an extensive solid solution series with properties that should vary continuously and smoothly as the fraction of barium is increased. This ceramic alloy can be designated by the general formula $Ba_xSr_{1-x}Y_2O_4$ wherein X can be varied from 0 to 1 and yet a single phase material be retained.

Figure 4:
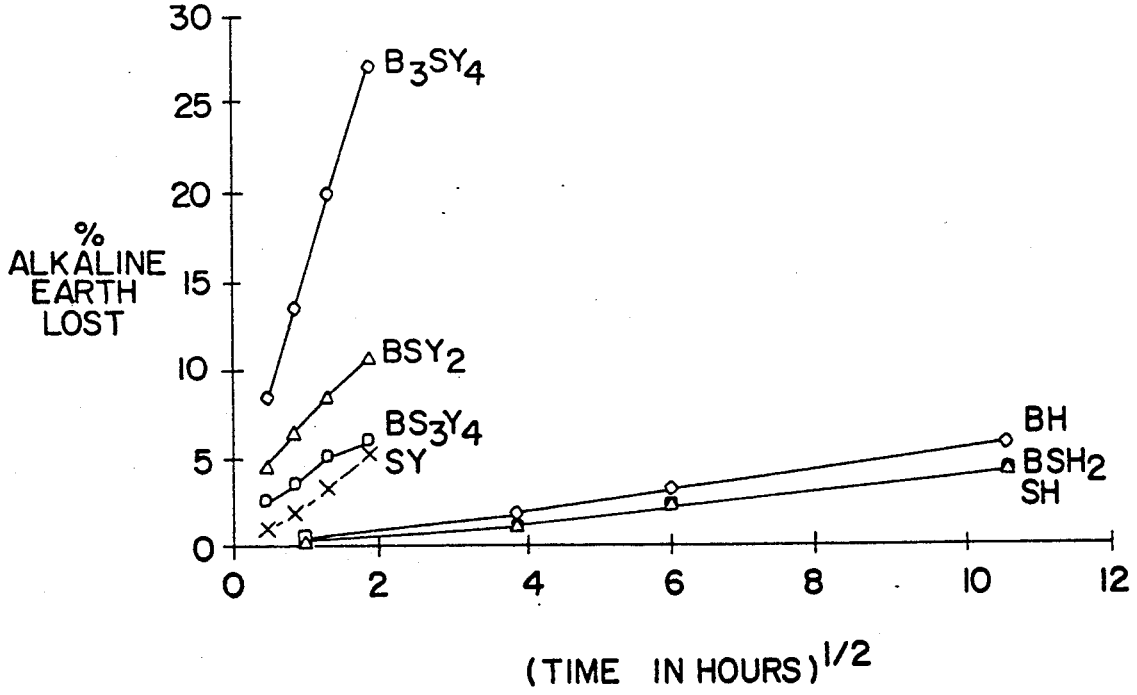
FIG. 4 is a graph of mass loss of $Ba_xSr_{1-x}Y_2O_4$ and $Y_2O_3$ and $Ba_xSr_{1-x}HfO_3$ alloys at 1600° C. in vacuum.

In order to select appropriate materials useful in testing lamps as described herein, mass loss measurements were made on mixed $Ba_xSr_{1-x}Y_2O_4$ solid solutions, and mixed $Ba_xSr_{1-x}HfO_3$ solid solutions. One-quarter inch pellets of about 500 milligrams weight of the ceramic powders were pressed to 55% density and sintered in $O_2$ at 1075° C. for 15 hours. The pellets were then fired at constant temperature for up to 110 hours in vacuum. FIG. 4 shows the mass loss at 1600° C. The mixed yttrates show higher mass loss rates than the mixed hafnates. With the mixed yttrates the mass loss at 1600° C. at 4 hours varies from about 5% to more than 25%, while the mass loss of the mixed hafnates is much lower and in fact is about 5% at 120 hours.

The mass loss rates is an important parameter in determining the performance of an emitter. Previous results show the mixed hafnates to have poor lumen maintenance. Cathode falls increased with lamp life indicating a poor supply of electroactive alkaline earth species to the cathode emitting surface. The yttrates have greater volatility than the hafnates resulting in a better supply of Ba and Sr to the cathode tip. The rate of mass loss is dependent on the solid solution composition. The higher the barium content the greater the mass loss rate. With $Ba_xSr_{1-x}Y_2O_4$ alloys there are a range of volatilities from which to choose. Different lamp applications which require different alkaline earth volatilities can be serviced by selecting the appropriate barium to strontium ratio (or x in $Ba_xSr_{1-x}Y_2O_4$).

Figure 5:
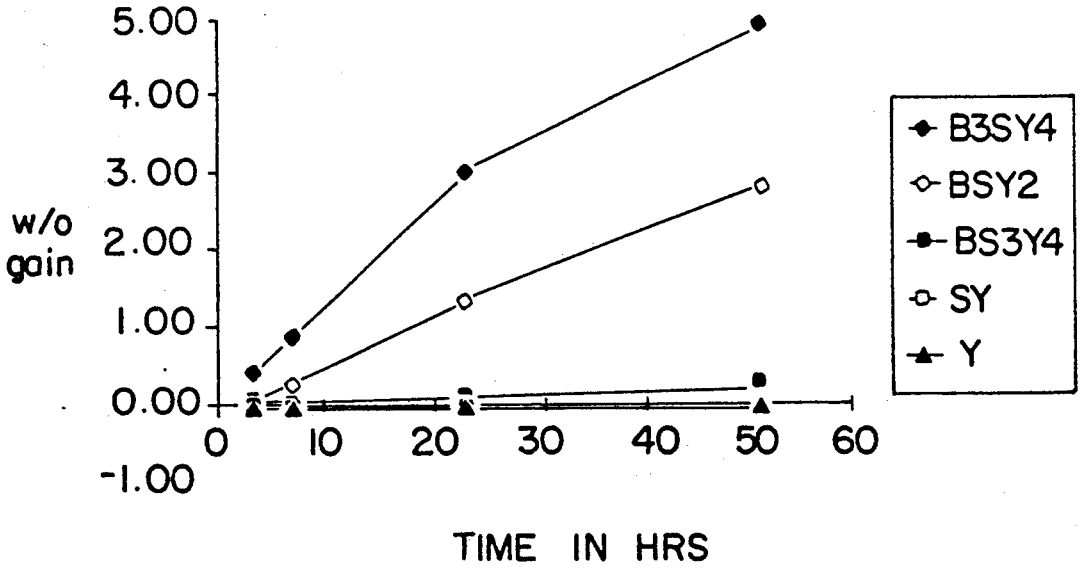
FIG. 5 is a graph of mass gain of $Ba_xSr_{1-x}Y_2O_4$ alloys at room temperature in laboratory air.

To facilitate the ease of manufacture of lamps, the emissive material should be unreactive with moisture and carbon dioxide in the air. To test the atmospheric reactivity of the mixed yttrates one-quarter inch pellets of about 500 milligrams weight of the ceramic powders were pressed to 55% density and sintered in $O_2$ r 1075° C. for 15 hours. The pellets were then exposed to laboratory air for 50 hours. The weight gain was recorded. The results are shown in FIG. 5. The phases $Y_2O_3$, $SrY_2O_4$, and $Ba_{0.25}Sr_{0.75}Y_2O_4$ are unreactive with lab air, but $Ba_{0.5}Sr_{0.5}Y_2O_4$ and $Ba_{0.75}Sr_{0.25}Y_2O_4$ are reactive with lab air and should be handled with some care.

With the foregoing in mind, a plurality of high pressure sodium vapor discharge lamps were made using emission material of the type produced under EXAMPLE 1, EXAMPLE 2, EXAMPLE 3, and EXAMPLE 4. In addition, a plurality of high pressure sodium vapor discharge lamps were produced using $Y_2O_3$ as an emission material. In each case, electrodes were coated by vacuum impregnating a tungsten wire coil using a respective emission material in a slurry of methanol. Each coated electrode was dried at about 50° C. for about one half hour and then sintered in a hydrogen containing atmosphere at about 1600° C. for about forty-five minutes. Each resulting activated electrode was cleaned of excess oxide materials by tumbling in a jar in a known manner. A plurality of high pressure sodium lamps were fabricated with an unsaturated vapor sodium-mercury amalgam fill using electrodes which were so produced.

In particular, a plurality of 400 watt and 70 watt lamps were produced in a known manner, some having electrodes coated with the emission material of EXAMPLE 1, some having electrodes coated with the emission material of EXAMPLE 2, some having electrodes coated with the emission material of EXAMPLE 3, some having electrodes coated with the emission material of EXAMPLE 4, and some having $Y_2O_3$ (also referred to herein as Y) as an emission material. Each 400 watt lamp included an arc tube having the following specifications:

| | |
|---|---|
| arc tube cavity length | 105 millimeters |
| arc tube inside diameter | 8.4 millimeters |
| arc length | 90 millimeters |
| Xe pressure | 80 torr |
| amalgam | 5 pills of 0.6 milligram of 3.4 weight percent sodium in mercury |
| length of niobium tube | 12 millimeters |
| outer diameter of niobium | 4.0 millimeters |

Except as noted herein, such lamps included a polycrystalline alumina arc tube.

Each 70 watt lamp included an arc tube having the following specifications:

| | |
|---|---|
| arc tube cavity length | 51 millimeters |
| arc tube inside diameter | 4.0 millimeters |
| arc length | 40 millimeters |
| Xe pressure | 120 torr |
| amalgam | 1 pill of 0.75 milligram of 3.4 weight percent sodium in mercury |
| length of niobium tube | 9 millimeters |

-continued

| | |
|---|---|
| outer diameter of niobium tube | 2.2 millimeters |

Each 70 watt lamp included a polycrystalline alumina arc tube.

Figure 6:
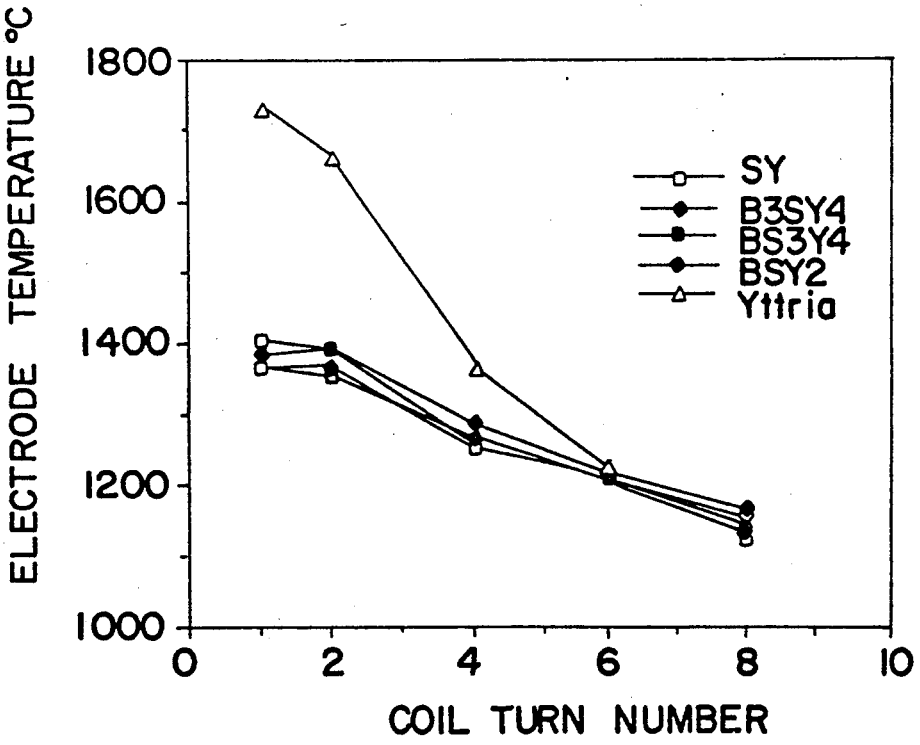
FIG. 6 is a graph of electrode temperature profile for $Y_2O_3$, $SrY_2O_4$, $Ba_{0.75}Sr_{0.25}Y_2O_4$, $Ba_{0.5}Sr_{0.5}Y_2O_4$, and $Ba_{0.25}Sr_{0.75}Y_2O_4$.

FIG. 6 is a graph which represents 400 watt lamps fabricated as discussed above but having a sapphire arc tube so that the cavity of such arc tube can be viewed. FIG. 6 depicts the temperature at each turn of the electrode coil such as the coil of FIG. 2, the "Coil Turn Number 0" representing the tip of the coil, the "Coil Turn Number 2" representing the second turn from the tip, etc. In FIG. 6, each plotted line represents that data for one lamp tested for each type of emission material noted in the graph. In order to provide an improved lamp it is desirable to lower the temperature of the electrode. It is clear from FIG. 6 that electrodes of lamps of the present invention have relatively low temperature profiles.

FIGS. 7 to 14 are graphs which set forth various operational characteristics of the foregoing 400 watt and 70 watt lamps. Each plotted line represents data averaged for two to four lamps tested for each type of emission material noted in each graph.

Figure 7:
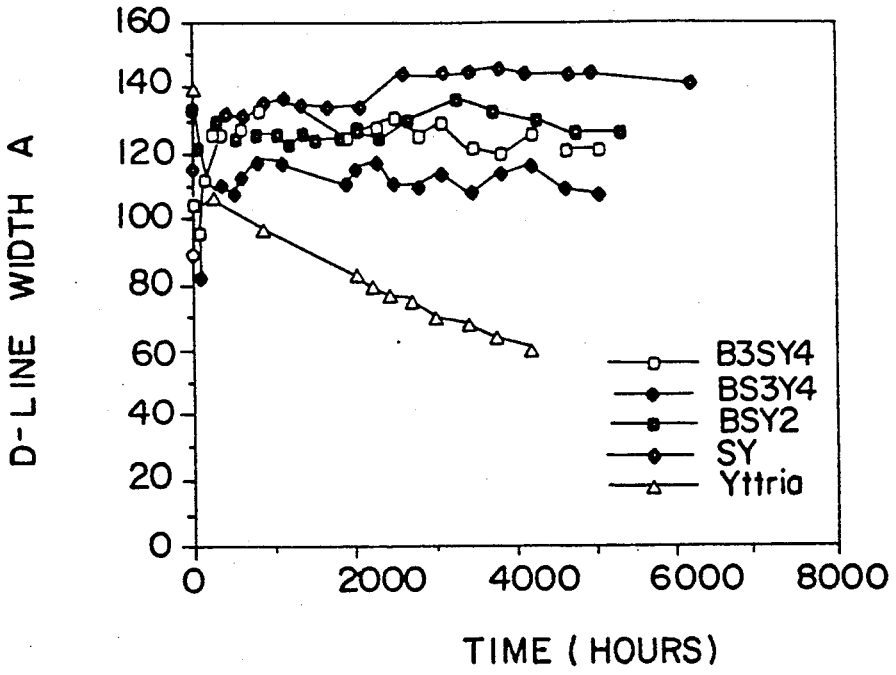
FIG. 7 is a graph of sodium D line maintenance for 400 watt HPS lamps with electrodes containing $Y_2O_3$, $SrY_2O_4$, $Ba_{0.75}Sr_{0.25}Y_2O_4$, $Ba_{0.5}Sr_{0.5}Y_2O_4$, and $Ba_{0.25}Sr_{0.75}Y_2O_4$ emissive materials.
Figure 12:
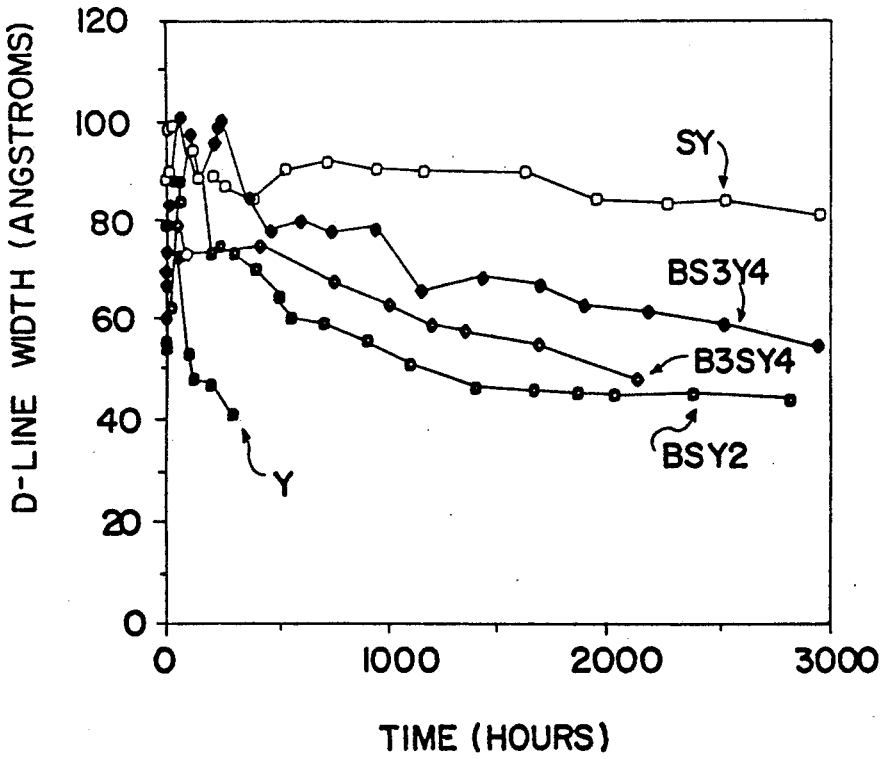
FIG. 12 is a graph of D line maintenance for 70 watt HPS lamps with electrodes containing $SrY_2O_4$, $Y_2O_3$, $Ba_{0.75}Sr_{0.25}Y_2O_4$, $Ba_{0.5}Sr_{0.5}Y_2O_4$, and $Ba_{0.25}Sr_{0.75}Y_2O_4$ emissive materials.

FIGS. 7 and 12 represent 400 watt and 70 watt lamps. Respectively, and depict D-line maintenance which has been measured over time in the usual manner. The D-line is the separation of the self-reversed width of the Na line at 589 nm. It is a measure of the sodium pressure in the arc. It is clear that lamps of the present invention are very stable, their D-lines not dropping significantly below the initial D-line over extended use. Such lamps have excellent sodium maintenance.

Figure 8:
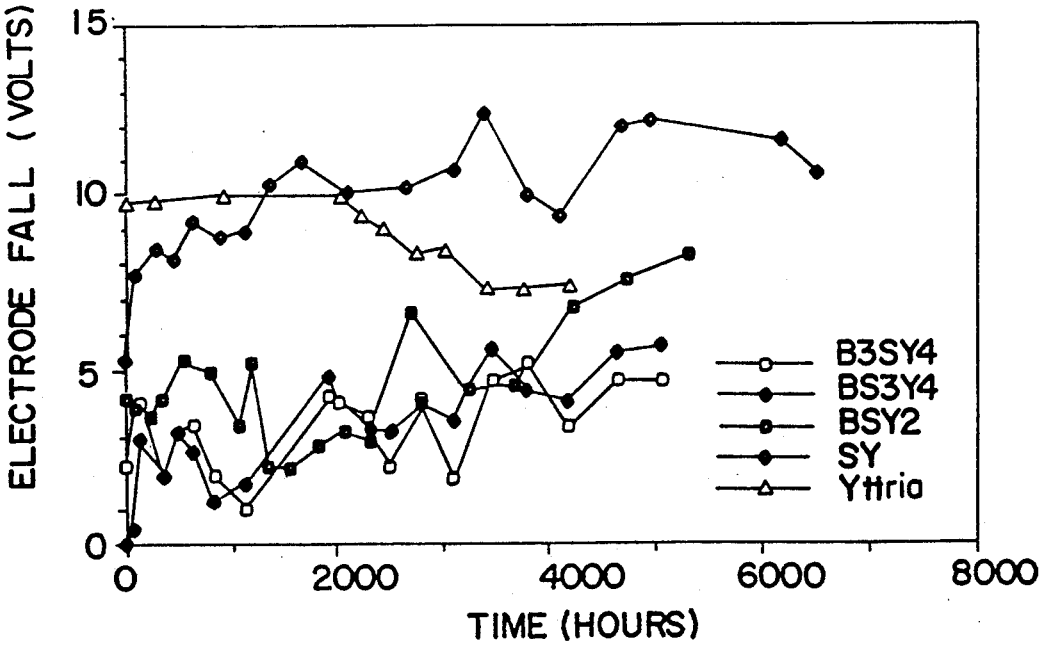
FIG. 8 is a graph of electrode voltage maintenance for 400 watt HPS lamps with electrodes containing $Y_2O_3$, $SrY_2O_4$, $Ba_{0.75}Sr_{0.25}Y_2O_4$, $Ba_{0.5}Sr_{0.5}Y_2O_4$, and $Ba_{0.25}Sr_{0.75}Y_2O_4$ emissive materials.
Figure 13:
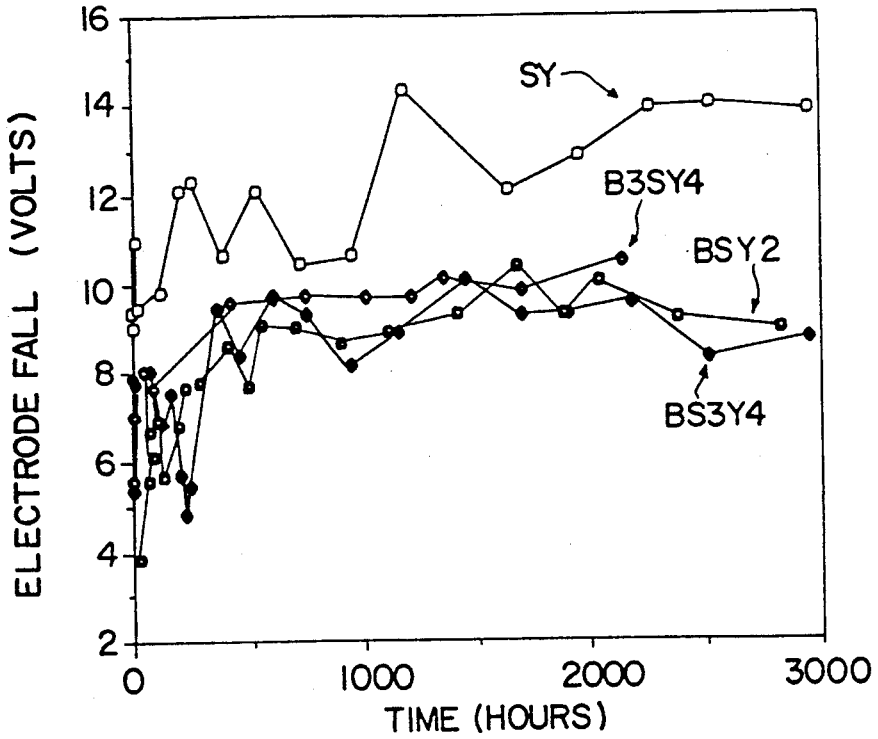
FIG. 13 is a graph of electrode voltage maintenance for 70 watt HPS lamps with electrodes containing $SrY_2O_4$, $Y_2O_3$, $Ba_{0.75}Sr_{0.25}Y_2O_4$, $Ba_{0.5}Sr_{0.5}Y_2O_4$, and $Ba_{0.25}Sr_{0.75}Y_2O_4$ emissive materials.

FIGS. 8 and 13 represent 400 watt and 70 watt lamps, respectively, and depict electrode fall which has been measured in volts over time. Electrode voltage is a measure of electrode fall and electrode power loss. Electrode voltage has been computed using the following equation:

$$V_{el} = V_{la} - l\,(A + B\,.\,\text{D-line}),$$

where $V_{el}$ = electrode voltage $V_{la}$ = lamp voltage l = arc length in millimeters D-line = separation of Na D-line peaks in Angstroms A = 1.42 volts/millimeter (for a 70 watt lamp with 0.75 milligrams of 3.4 weight percent amalgam and 120 torr Xe) or A = 0.778 volts/millimeter (for a 400 watt lamp with 3.0 milligrams of 3.4 weight percent Na amalgam and 150 torr Xe)

B = $7.0\,.\,10^{-3}$ volts/(millimeter-Angstrom) (for a 70 watt lamp) or

B = $3.3\,.\,10^{-3}$ volts/(millimeter-Angstrom) (for a 400 watt lamp)

A low electrode voltage is important for lamp performance because any energy consumed by the operation of the electrodes is lost from the lamp light output. All of the emission materials of the present invention have low electrode voltages.

Figure 9:
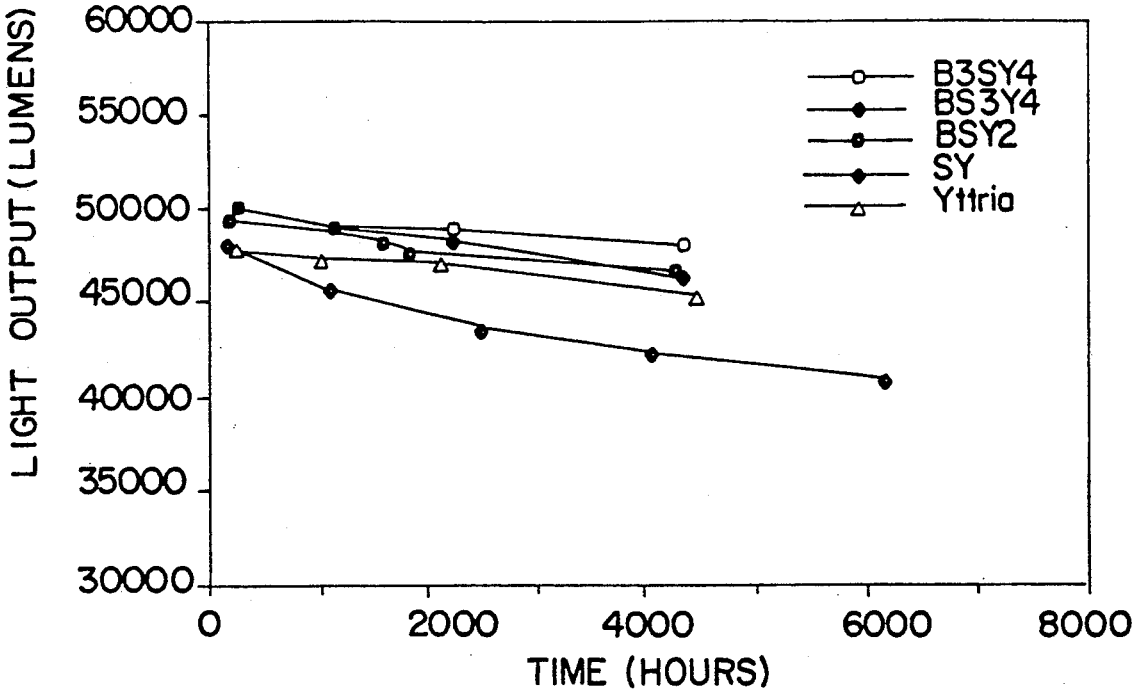
FIG. 9 is a graph of lumen maintenance for 400 watt HPS lamps with electrodes containing $Y_2O_3$, $SrY_2O_4$, $Ba_{0.75}Sr_{0.25}Y_2O_4$, $Ba_{0.5}Sr_{0.5}Y_2O_4$, and $Ba_{0.25}Sr_{0.75}Y_2O_4$ emissive materials.
Figure 11:
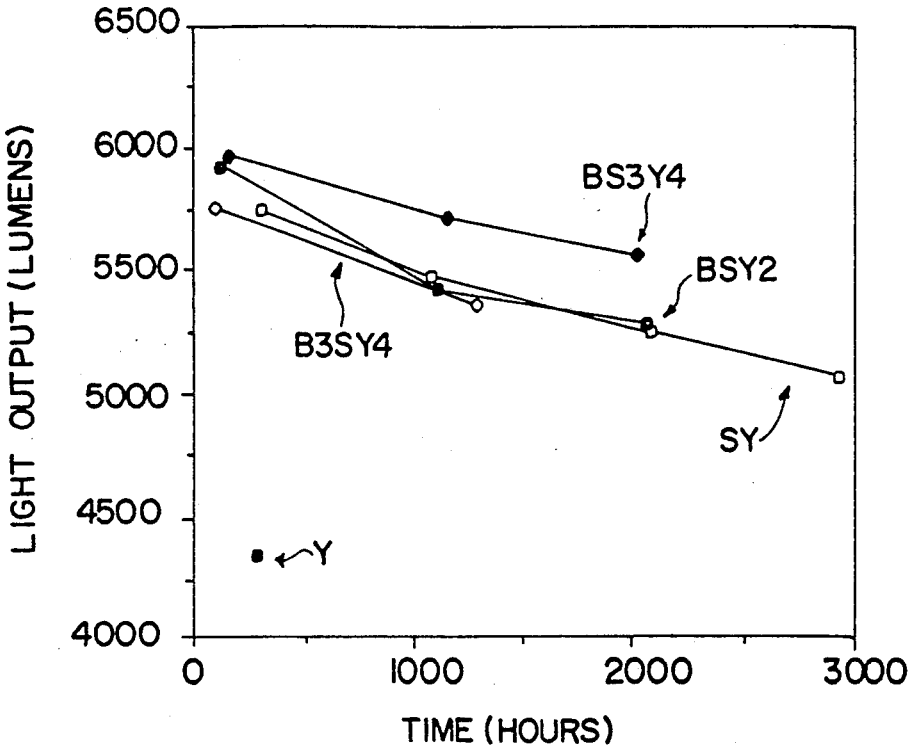
FIG. 11 is a graph of lumen maintenance for 70 watt HPS lamps with electrodes containing $SrY_2O_4$, $Ba_{0.75}Sr_{0.25}Y_2O_4$, $Ba_{0.5}Sr_{0.5}Y_2O_4$, and $Ba_{0.25}Sr_{0.75}Y_2O_4$ emissive materials.

FIGS. 9 and 11 represent 400 watt and 70 watt lamps, respectively, and depict light output which has been measured in lumens over time in the usual manner. All of the emission materials of the present invention have excellent initial lumens and excellent lumen maintenance.

Figure 10:
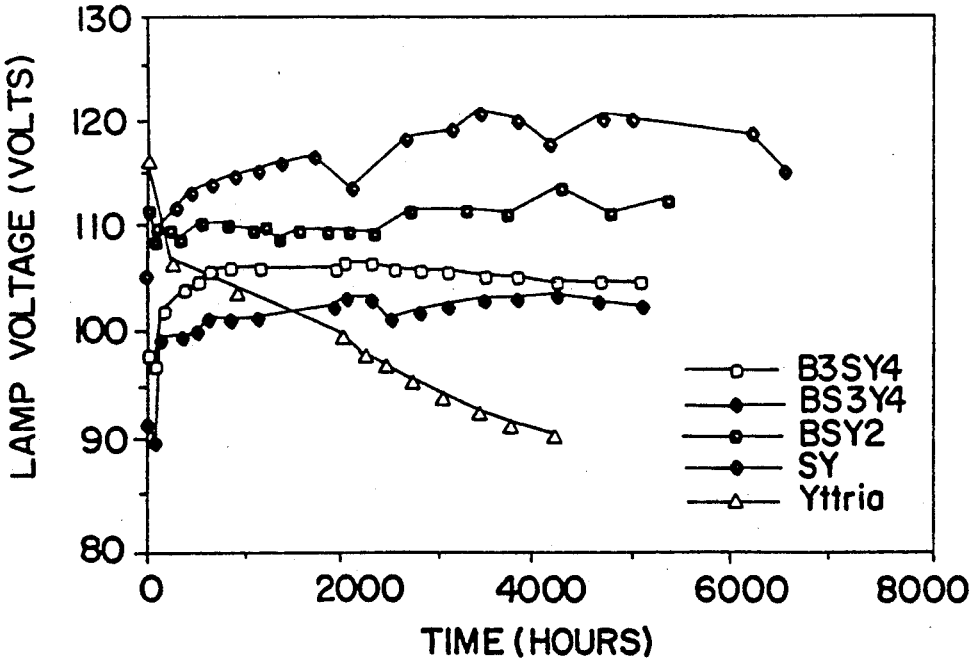
FIG. 10 is a graph of lamp voltage maintenance for 400 watt HPS lamps with electrodes containing $Y_2O_3$, $SrY_2O_4$, $Ba_{0.75}Sr_{0.25}Y_2O_4$, $Ba_{0.25}Sr_{0.75}Y_2O_4$, and $Ba_{0.5}Sr_{0.5}Y_2O_4$ emissive materials.
Figure 14:
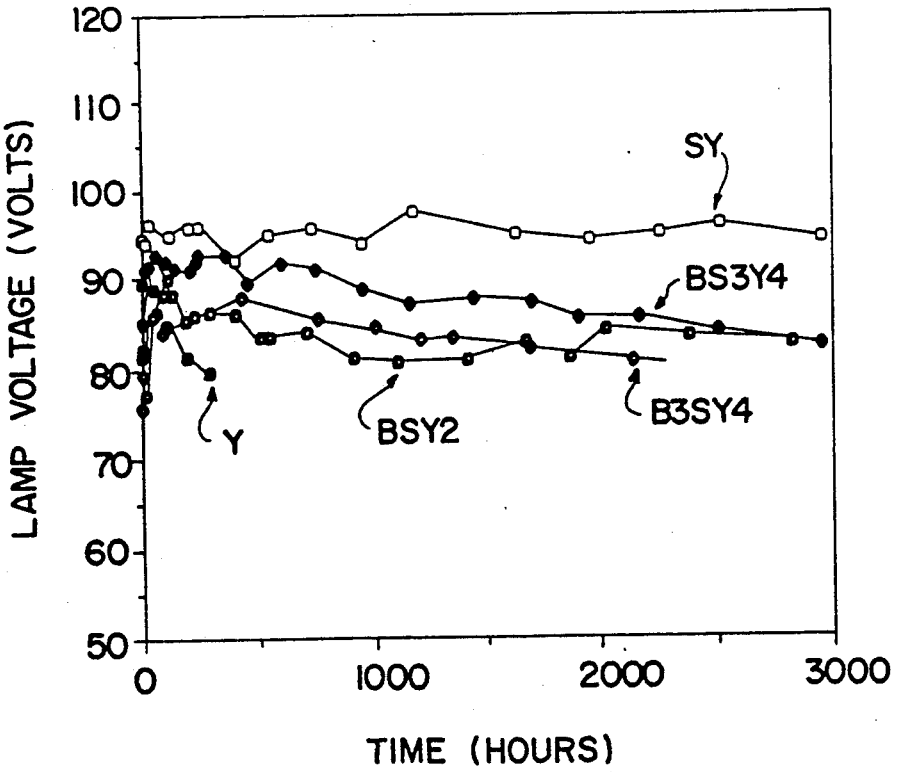
FIG. 14 is a graph of lamp voltage maintenance for 70 watt HPS lamps with electrodes containing $SrY_2O_4$, $Ba_{0.75}Sr_{0.25}Y_2O_4$, $Ba_{0.5}Sr_{0.5}Y_2O_4$, and $Ba_{0.25}Sr_{0.75}Y_2O_4$ emissive materials.

FIGS. 10 and 14 represent 400 watt and 70 watt lamps, respectively, and depict lamp voltage which has been measured over time in the usual manner. Typically, lamp voltage increases with sodium and mercury pressures and with increasing electrode fall. Once a lamp becomes unsaturated in sodium and mercury, the voltage maintenance is determined by the aging of the cathodes (which tend to increase the lamp voltage) and by the loss of sodium with life (which tends to decrease the lamp voltage). All of the emission materials of the present invention give excellent performance, particularly in the 400 watt lamps, there being neither a voltage rise due to cathode fall increase nor a voltage fall due to sodium loss.

It has been observed that vapor discharge devices as described herein overcome the disadvantages noted herein of prior art devices comprising conventional emissive material. It is believed that this results from use of the emissive material of the present invention which is highly refractory and has an excellent electron emitting activity, very low sodium reactivity, low operating temperature, good starting characteristics, low initial deterioration of the D line such that the sodium D line remains high for the life of the lamp, low electrode voltage, good lumen maintenance, and ease of manufacture.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

We claim:

1. A vapor discharge device comprising:

a base;

a sealed outer envelope connected to said base;

a pair of lead-in conductors extending from said base into said sealed envelope;

at least one arc tube disposed within said sealed outer envelope, each arc tube comprising a discharge-substaining fill, a first electrode electrically connected to a first lead-in conductor of said pair of lead-in conductors, and a second electrode electrically connected to a second lead-in conductor of said pair of lead-in conductors, said first electrode and second electrode being adapted to have an elongated arc discharge maintained therebetween; and an electron emissive material disposed on said first electrode and said second electrode, said electron emissive material comprising reacted $Ba_xSr_{1-x}Y_2O_4$ wherein X is in a range of from 0.05 to 0.95.

2. The vapor discharge device of claim 1 wherein each electrode of said pair of electrodes is a coil.

3. The vapor discharge device of claim 2 wherein each coil is formed from a material selected from the group consisting of tungsten, molybdenum, rhenium, tantalum, and mixtures thereof.

4. The vapor discharge device of claim 3 wherein said coil is disposed upon a tungsten rod.

5. The vapor discharge device of claim 4 wherein said arc tube is formed of polycrystalline alumina.

6. The vapor discharge device of claim 5 wherein said polycrystalline alumina arc tube is sealed at each end with at least one section of substantially flat polycrystalline alumina having a hole formed in said section, said section being sealed to said tube with a glass or ceramic frit and said electrodes being disposed in said holes and sealed thereto, whereby an inner envelope is formed.

7. The vapor discharge device of claim 6 wherein each electrode of said pair of electrodes is a coil of tungsten wire disposed upon a tungsten rod.

8. The vapor discharge device of claim 7 wherein said vapor discharge device is a high pressure vapor discharge lamp.

9. The vapor discharge device of claim 8 wherein said high pressure vapor discharge lamp is a sodium vapor discharge lamp.

10. The vapor discharge device of claim 8 wherein said high pressure vapor discharge lamp is a mercury vapor discharge lamp.

11. An emissive material for use in a vapor discharge device comprising reacted $Ba_xSr_{1-x}Y_2O_4$ wherein x is in a range of from 0.05 to 0.95.

12. The emissive material of claim 11 wherein X is 0.5.

13. The emissive material of claim 11 wherein X is 0.25.

14. The emissive material of claim 11 wherein X is 0.75.

* * * * *